US012167785B2

(12) United States Patent
Jang

(10) Patent No.: US 12,167,785 B2
(45) Date of Patent: Dec. 17, 2024

(54) CONTAINER PUFF AND CONTAINER PROVIDED WITH SAME

(71) Applicants: HWL CO., LTD., Incheon (KR); G&V COSMETICS CO., LTD., Incheon (KR)

(72) Inventor: Gyu Yeun Jang, Incheon (KR)

(73) Assignees: HWL CO., LTD., Incheon (KR); MORAE KOREA CO., LTD., Daegu (KR)

( * ) Notice: Subject to any disclaimer, the term of this patent is extended or adjusted under 35 U.S.C. 154(b) by 450 days.

(21) Appl. No.: 17/610,338

(22) PCT Filed: Sep. 18, 2019

(86) PCT No.: PCT/KR2019/012082
§ 371 (c)(1),
(2) Date: Dec. 3, 2021

(87) PCT Pub. No.: WO2020/235750
PCT Pub. Date: Nov. 26, 2020

(65) Prior Publication Data

US 2022/0218089 A1 Jul. 14, 2022

(30) Foreign Application Priority Data

May 17, 2019 (KR) ..... 10-2019-0057830

(51) Int. Cl.
*A45D 40/24* (2006.01)
*A45D 34/04* (2006.01)
*A45D 40/26* (2006.01)

(52) U.S. Cl.
CPC ..... *A45D 34/04* (2013.01); *A45D 40/26* (2013.01); *A45D 2200/056* (2013.01); *A45D 2200/1018* (2013.01)

(58) Field of Classification Search
CPC ..... A45D 37/00; A45D 2200/1009; A45D 2200/1018; A45D 34/04; A45D 40/26; B05C 17/002
See application file for complete search history.

(56) References Cited

U.S. PATENT DOCUMENTS

2007/0277844 A1* 12/2007 Gueret ..... A45D 33/02 132/320

FOREIGN PATENT DOCUMENTS

KR 200274599 5/2002
KR 200341782 2/2004
(Continued)

OTHER PUBLICATIONS

International Search Report—PCT/KR2019/012082 dated Feb. 14, 2020.

*Primary Examiner* — Rachel R Steitz
(74) *Attorney, Agent, or Firm* — CANTOR COLBURN LLP

(57) ABSTRACT

Provided is a container puff and a container provided with same, the container puff including a cushion such as liquid silicone filled in a space between a soft type first skin and a hard type second skin, and maximizing application performance and convenience of use of a stored material discharged from a coupled container through a through hole (or a nozzle provided through the through hole). By using the container puff and the container provided with same, the spreadability (uniform and fast application characteristics) of the agents is improved and the use thereof is convenient when cosmetics such as sunblock, medications such as a pain relieving liquid, adhesives such as glue, and various liquid application agents such as other gel type agents are rubbed onto an object subjected to application, such as a body.

6 Claims, 8 Drawing Sheets

(56) References Cited

FOREIGN PATENT DOCUMENTS

| | | |
|---|---|---|
| KR | 200378581 | 3/2005 |
| KR | 200405171 | 1/2006 |
| KR | 2020080001934 | 6/2008 |
| KR | 100917319 | 9/2009 |
| KR | 2020130006976 | 12/2013 |
| KR | 101392980 | 5/2014 |
| KR | 200477055 | 5/2015 |

* cited by examiner

CONTAINER PUFF AND CONTAINER PROVIDED WITH SAME

TECHNICAL FIELD

The present disclosure relates to a container puff and a container having the same.

More particularly, the present disclosure relates to a container puff and a container having the same, with which the spreadability (uniform and fast application characteristics) of agents is improved and the use thereof is convenient when cosmetics such as sunblock, medications such as a pain relieving liquid, adhesives such as glue, and various liquid application agents such as other gel type agents are rubbed onto an object subjected to application, such as a body.

Thus, the container puff includes a cushion such as liquid silicone filled in a space between a soft type first skin and a hard type second skin, and maximizes application performance and convenience of use of a stored material discharged from a coupled container through a through hole (or a nozzle provided through the through hole).

BACKGROUND ART

The following are some of the methods used in applying an application agent such as cosmetics to an object subjected to application such as the skin: using an absorbent sponge provided at the end of the nozzle as in the case of liquid glue; using a disc-type puff (for applying cosmetics such as foundation) that a user holds and uses by hand; and directly rubbing an application agent onto an object subjected to application such as the skin after the application agent itself, such as cosmetics including sunblock, is molded into a solid stick type.

Meanwhile, in the case of cosmetics provided in a tube-type container, the cosmetics generally come in gel form or liquid form, and the user directly rubs the contents discharged to the outside of a nozzle tip on the skin by hand.

As a related art, there is Korean Utility Model Registration No. 20-0274599 "NOZZLE TIP FOR COSMETIC VESSEL IN TUBE TYPE".

This registered design relates to a tube-type cosmetic container composed of a nozzle tip having a discharge hole as an integral or assembled type at the tip of the tube container, with a napped (fluffy raised) surface formed by flocking treatment on the tip surface and outer periphery of the nozzle tip, so as to provide convenience of the use while minimizing discomfort that occurs when the skin comes into contact with the hard plastic nozzle tip formed at the tip end of the tube neck due to the use of the tube-type cosmetic container.

There is also Korean Utility Model Application Publication No. 20-2008-0001934 "NOZZLE EDGE STRUCTURE OF STICK TYPE COSMETIC CONTAINER".

This published design relates to a stick-type cosmetic container in which a connection cap is coupled to the tip of the stick-type container, and a nozzle tip having an inclined surface and a discharge hole at the end is coupled to the tip of the connection cap, a recessed groove portion having a curved curvature is formed on the inclined surface of the end of the nozzle tip, a hemispherical protrusion is formed on the whole of the recessed groove portion, and the nozzle tip having the recessed groove portion and the protrusion is molded with a soft elastic material and is configured to be combined with the connection cap.

In addition, there is Korean Utility Model Registration No. 20-0378581 "NOZZLE TIP FOR COSMETICS APPLICATION".

This registered design relates to a nozzle tip of a cosmetic container, the container including: a container body with the upper part open, male threads on the outer periphery of the upper end, and lip gloss being accommodated inside; a nozzle tip to be coupled to the tip of the container body; and a cap having female threads on the lower inner periphery to be coupled with the male threads of the container body. The nozzle tip including: a through hole formed through the center of the nozzle tip so that the lip gloss in the container body is discharged to the outside; a locking jaw formed around the lower outer periphery of the nozzle tip to prevent it from falling off after being mounted on the container body; and a close-fitting piece attached to the upper part of the container body around the middle and outer periphery. The whole nozzle tip is made of silicone material by molding.

Also, there is Korean Utility Model Registration No. 20-0341782 "APPLICATOR FOR COSMETICS".

This registered design relates to a series of applicator tips for applying cosmetics used in combination with a cosmetic dispensing unit of a cosmetic container including a cosmetic accommodating unit and the cosmetic discharging unit, and more specifically, relates to applicator tips for applying cosmetics that can be appropriately selected for easy application according to the type of cosmetics and used in combination with the cosmetic container.

However, in the case of these container-coupled nozzles proposed in the related art, there is a risk of skin damage to infants and women since the nozzle tip in contact with the skin is made of relatively hard materials, and thus it is not in the spotlight commercially because the nozzle tip is easy to break and can even cause injuries. There is also a problem that spreadability and application characteristics are not satisfactory.

DISCLOSURE

Technical Problem

Accordingly, the present disclosure is proposed to solve the above-described problems and an objective of the present disclosure is to provide a container puff and a container having the same, with which the spreadability (uniform and fast application characteristics) of agents is improved and the use thereof is convenient when cosmetics such as sunblock, medications such as a pain relieving liquid, adhesives such as glue, and various liquid application agents such as other gel type agents are rubbed onto an object subjected to application, such as a body, since the container puff includes a cushion such as liquid silicone filled in a space between a soft type first skin and a hard type second skin, and maximizes application performance and convenience of use of a storage material discharged from a coupled container through a through hole (or a nozzle provided through the through hole).

Also, an objective of the present disclosure is to provide a container puff and a container having the same: in which each of the first and second skins is joined to each other by the outer 1-1 and 2-1 coupling parts and the central 1-2 and 2-2 coupling parts, respectively; in which, since the space between each coupling part is filled with a cushion such as silicone, the cushion itself is prevented from leaking while providing the softest possible feel to maximize spreadability; and in which the first and second skins are each composed of a soft material for contacting skin and a hard material for providing rigidity to ensure the tactile feel and compatibility with other components (containers or nozzles).

Moreover, an objective of the present disclosure is to provide a container puff and a container having the same: in which a through hole for a stored material discharged from the container is formed in the portion (inner flange) formed by the bonding of the central 1-2 and 2-2 coupling parts of the first and second skins, respectively, and a nozzle is combined with a second fixer composed of the through hole and the inner flange to ensure smooth discharge of the stored material.

Here, the first skin has a recess recessed toward the 1-2 coupling part for the inner flange at the end, and the nozzle is accommodated and depressed in the recess so that it is not exposed.

Further, the outer flange for container coupling formed by joining the outer 1-1 and 2-1 coupling parts of the first and second skins, respectively, serves as the first fixer, and this first fixer is, when observed from a top of the container puff, located inside an applicator surface to be hidden by the applicator surface of the first skin that is exposed when combined with the container and in contact with the skin, so that the hard components (first and second fixers or nozzles) do not come into contact with the skin to ensure excellent tactile feel and spreadability.

In addition, an objective of the present disclosure is to provide a container puff and a container having the same, in which an absorbent member is partially or entirely provided on the surface of the first skin, exposed and in contact with the skin when the container is combined, to secure optimal application characteristics according to a stored material and purpose.

Technical Solution

According to an embodiment of the present disclosure for achieving the objective as described above, provided is a container puff, including:

- a first skin having a storage part and a 1-1 coupling part for an outer flange;
- a cushion filling the storage part of the first skin to provide elasticity; and
- a second skin having a 2-1 coupling part coupled to the 1-1 coupling part of the first skin, and sealing the storage part.

Also, it is preferable that in the case of the container puff according to the present disclosure,

- the first skin has a recess on an inside thereof, with a 1-2 coupling part for an inner flange being provided at an end of the recess; the second skin has a 2-2 coupling part coupled to the 1-2 coupling part; and a second fixer is formed in the 1-2 and 2-2 coupling parts, and a through hole surrounded by the second fixer is provided,
- a nozzle is coupled to the through hole,
- the 1-1 and 2-1 coupling parts form a first fixer coupled to a container,
- the nozzle is accommodated in the recess and depressed so that it is not exposed,
- the first skin is made of a soft material, and the second skin is made of a hard material,
- an absorbent member is coupled to a surface of the first skin that is exposed when combined with a container and configured to come into contact with user's skin, and
- the first fixer, when observed from a top of the container puff, is located inside an applicator surface of the first skin to be hidden by the applicator surface of the first skin that is exposed when combined with the container and configured to come into contact with user's skin.

Advantageous Effects

A container puff and a container having the same according to the present disclosure, include a cushion such as liquid silicone filled in a space between a soft type first skin and a hard type second skin, and maximizing application performance and convenience of use of a stored material discharged from a coupled container through a through hole (or a nozzle provided through the through hole). In the case of the container puff and a container having the same, each of the first and second skins is joined to each other by the outer 1-1 and 2-1 coupling parts and the central 1-2 and 2-2 coupling parts, respectively; since the space between each coupling part is filled with a cushion such as silicone, the cushion itself is prevented from leaking while providing the softest possible feel to maximize spreadability; the first and second skins are each composed of a soft material for contacting skin and a hard material for providing rigidity to ensure the tactile feel and compatibility with other components (containers or nozzles), a through hole for a stored material discharged from the container is formed in the portion (inner flange) formed by the bonding of the central 1-2 and 2-2 coupling parts of the first and second skins, respectively, and a nozzle is combined with the second fixer composed of the through hole and the inner flange to ensure smooth discharge of the stored material; the first skin has a recess recessed toward the 1-2 coupling part for the inner flange at the end, and the nozzle is accommodated and depressed in the recess so that it is not exposed; and the outer flange for container coupling formed by joining the outer 1-1 and 2-1 coupling parts of the first and second skins, respectively, serves as the first fixer, and this first fixer is, when observed from a top of the container puff, located inside an applicator surface to be hidden by the applicator surface of the first skin that is exposed when combined with the container and in contact with the skin, so that the hard components (first and second fixers or nozzles) do not come into contact with the skin to ensure excellent tactile feel and spreadability, in addition, an absorbent member is partially or entirely provided on the surface of the first skin, exposed and in contact with the skin when the container is combined, to secure optimal application characteristics according to a stored material and purpose, as a result, the spreadability (uniform and fast application characteristics) of the agents is improved and the use thereof is convenient when cosmetics such as sunblock, medications such as a pain relieving liquid, adhesives such as glue, and various liquid application agents such as other gel type agents are rubbed onto an object subjected to application, such as a body.

DESCRIPTION OF REFERENCE NUMERALS

Figure 1:
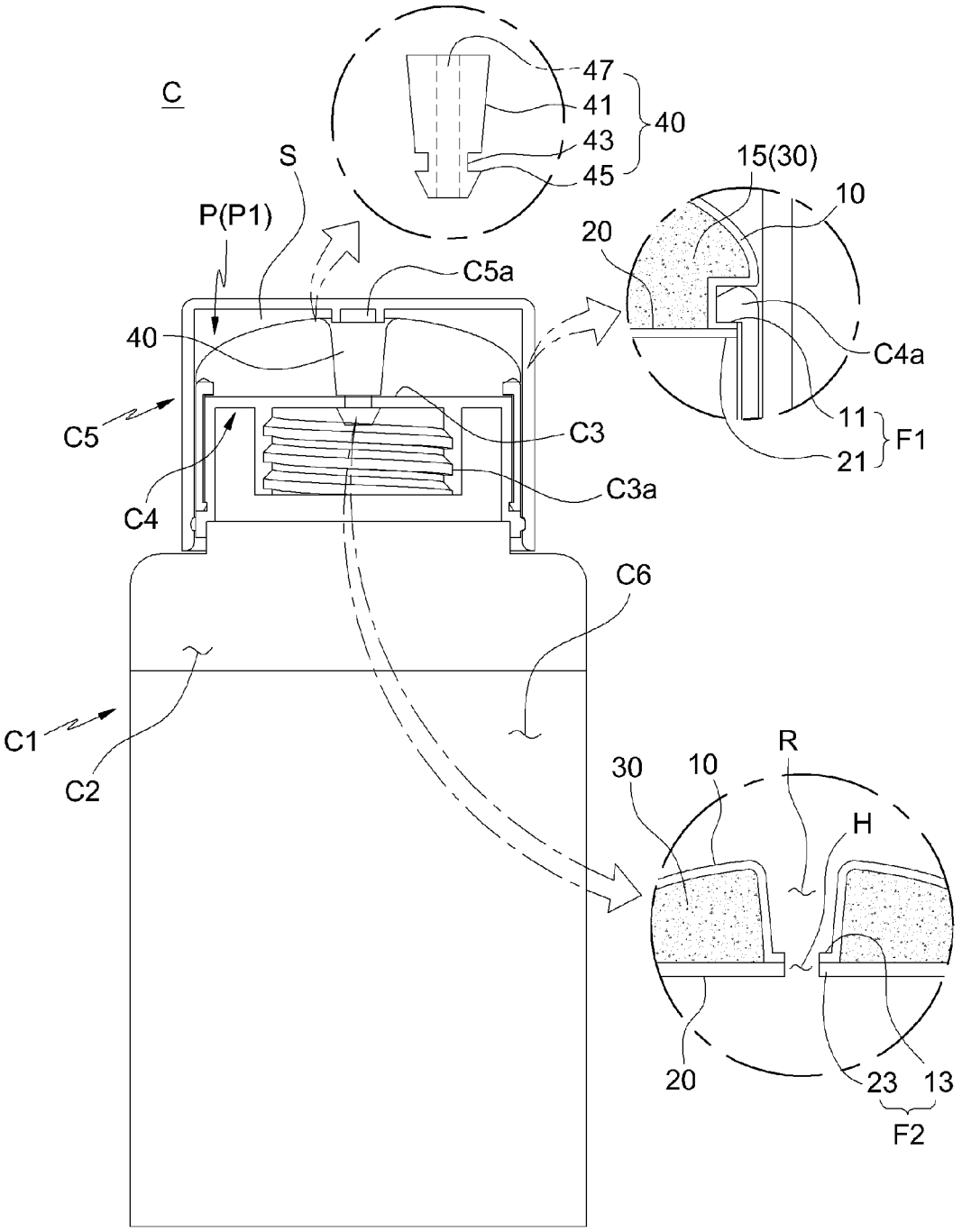
FIG. 1 is a combined cross-sectional view of a container puff and a container having the same according to the present disclosure.

P,P1,P2,P3: puff
10: first skin
11: 1-1 coupling part 13: 1-2 coupling part
15: storage part
20: second skin
21: 2-1 coupling part 23: 2-2 coupling part
40: nozzle
41: head 43: connecting portion
45: locking portion 47: discharge path
50A,50B: surface member
F1,F2: fixer H: through hole
R: recess
M: molding mold C: container

BEST MODE

Hereinafter, the present disclosure will be described in detail with reference to the accompanying drawings.

The present disclosure will now be described in detail based on aspects (or embodiments). The present disclosure may, however, be embodied in many different forms and should not be construed as being limited to only the embodiments set forth herein, but should be construed as covering modifications, equivalents or alternatives falling within ideas and technical scopes of the present disclosure.

In the figures, like reference numerals, particularly, reference numerals having the same last two digits or the same last two digits and letters refer to like elements having like functions throughout, and unless the context clearly indicates otherwise, elements referred to by reference numerals of the drawings should be understood based on this standard.

Also, for convenience of understanding of the elements, in the figures, sizes or thicknesses may be exaggerated to be large (or thick), may be expressed to be small (or thin) or may be simplified for clarity of illustration, but due to this, the protective scope of the present disclosure should not be interpreted narrowly.

The terminology used herein is for the purpose of describing particular aspects (or embodiments) only and is not intended to be limiting of the present disclosure. As used herein, the singular forms are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present disclosure belongs. It will be further understood that terms used herein should be interpreted as having a meaning that is consistent with their meaning in the context of this specification and the relevant art and will not be interpreted in an idealized or overly formal sense unless expressly so defined herein.

In this specification, it is to be noted that, when the functions of conventional elements and the detailed description of elements related with the present disclosure may make the gist of the present disclosure unclear, a detailed description of those elements may be omitted.

Terms such as "a first ~" and "a second ~" are used only for the purpose for distinguishing a constitutive element from other constitutive element, but constitutive element should not be limited to a manufacturing order, and the terms described in the detailed description of the invention may not be consistent with those described in the claims.

First of all, as shown in FIG. 1, a puff P (P1) according to the present disclosure is composed of a first skin 10, a second skin 20, and a cushion 30 provided in a storage part 15 between the first and second skins. In the present specification, for convenience, the first skin 10 is defined as the side exposed and in contact with the intended destination of use (applying destination) (an object subjected to application), such as the skin, while the side that is built-in and fixed by a cap of a container C, in particular an inner cap C4, is determined as the second skin 20. Also, the exposed area in direct contact with an object to be applied, such as the skin, is defined as an applicator surface S.

As in FIG. 4, the puff P is prepared as follows: arrange a sheet S10 for the first skin in an accommodation part M1 of a mold M having a central protrusion M2; put a sheet S20 for the second skin over it after putting in an artificial or natural elastic body 30S such as liquid silicone or polyurethane; and leave out an outer flange and an inner flange corresponding to first and second fixers F1, F2 and obtain the puff P by blanking using a Thompson mold etc. If necessary, the fixing of the puff to the container may be replaced in such a way that the cap of the container, particularly the inner cap, fixes the first skin. For example, the first skin may have a tapered shape as the cross-sectional area increases as the shape of the first skin becomes wider near the bottom, and since the hollow of the inner cap is smaller than the lower part of the first skin, fixation can be made in such a way that the puff is caught around the inner cap at the lower end of the first skin during assembly and is not separated.

A plurality of micro-suction holes may be formed in the mold M for adhesion to the bottom surface of a mold accommodation part M1 of the sheet S10 for the first skin 10, if necessary.

The bonding of the first skin and the second skin may be implemented in various ways depending on the situation, such as bonding by the properties of the material itself, thermal bonding, ultrasonic bonding, adhesive bonding, etc.

The elastic body 30S may be mass-produced in a hardened state to some extent due to increased viscosity over time when silicone or polyurethane is used. In addition, if necessary, the elastic body 30S may be a separate molded product or processed product. For productivity and subsequent quality maintenance, the elastic body is preferably made of a soft material such as silicone, PU, PE, or PC.

Sheets S10 and S20 for the first and second skins 10 and 20 may employ various synthetic resins such as PE, PC, PP, etc.

As such, the puff P (P1) according to the present disclosure improves the spreadability (uniform and fast application characteristics) of the agents and makes the use thereof convenient when cosmetics such as sunblock, medications such as a pain relieving liquid, adhesives such as glue, and various liquid application agents such as other gel type agents are rubbed onto an object subjected to application, such as a body.

In the case of the puff P (P1) according to the present disclosure, the first skin 10 has the storage part 15, a 1-1 coupling part 11 for the outer flange, and a 1-2 coupling part 13 for the inner flange.

The second skin 20 has 2-1 and 2-2 coupling parts 21, 23 coupled to the 1-1 and 1-2 coupling parts 11, 13 of the first skin 10, and seals the storage part 15 to hold the cushion 30, preventing leakage or exposure of the cushion itself, while maximizing the spreadability by providing a feeling as soft as possible.

As shown in the upper right dash-dotted line circle of FIG. 1, the 1-1 and 2-1 coupling parts 11 and 21 corresponding to the outer flange constitute a first fixer F1 for the outer flange coupled to the container, and as shown in the lower right dash-dotted line circle of FIG. 1, the 1-2 and 2-2 coupling parts 13 and 23 form a second fixer F2 for the inner flange corresponding to the perimeter of a through hole H.

Figure 4:
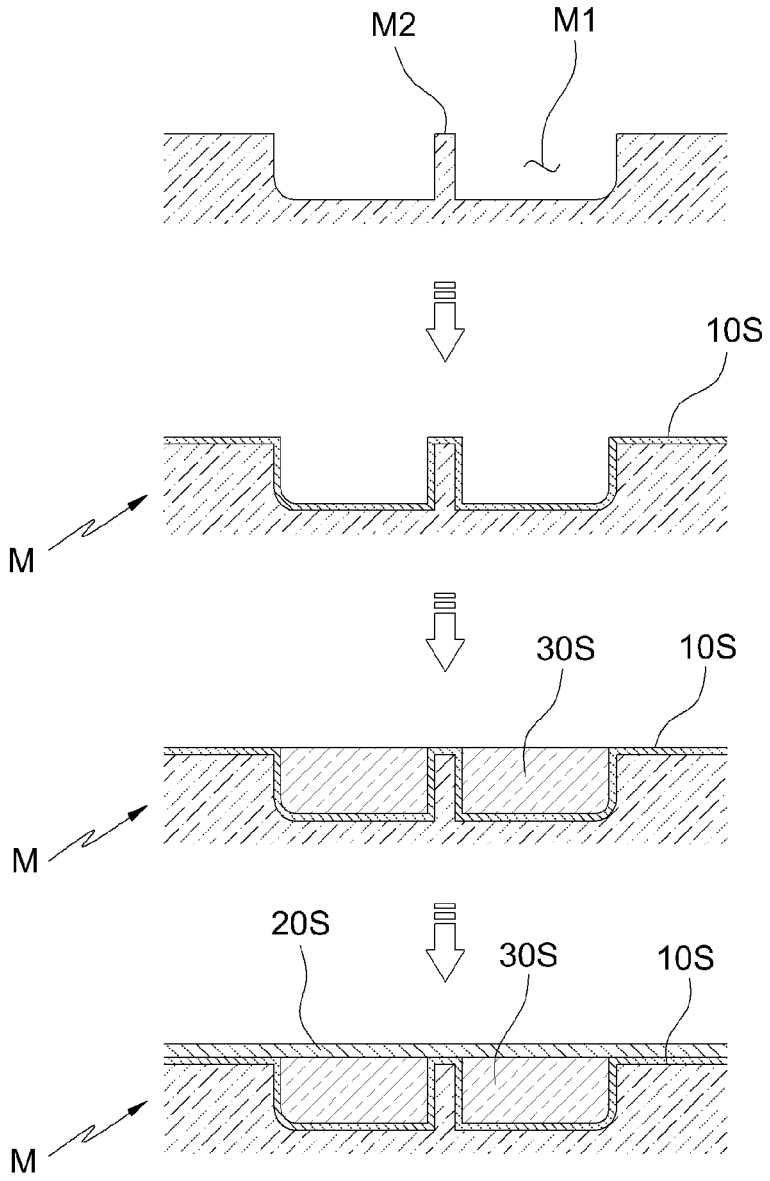
FIG. 4 is a view showing the manufacturing process of a container puff according to the present disclosure.

In particular, as in FIG. 4, the first skin has a recess R on the inside by the central protrusion M2 of the mold M, and at the end of the recess, the 1-2 coupling part 13 for the inner flange is provided.

If necessary, a nozzle 40 is coupled to the second fixer F2 composed of the through hole H and the inner flange to ensure smooth discharge of a stored material, and the nozzle 40 is accommodated and depressed, thus being not exposed due to the recess R, so it is possible to minimize irritation to the object subjected to application, such as the skin.

In addition, since the first skin 10 in contact with the object subjected to application such as user's skin is made of a soft material and the second skin 20 is made of a hard material,

- the soft type first skin protects the object subjected to application such as skin and guarantees the applicability of the stored material such as cosmetics, whereas
- the hard type second skin guarantees the fixing force when the cushion is mounted on the container and performs the function of maintaining the shape of the puff itself.

The soft type first skin and the hard type second skin refer to relative rigidities, and soft and hard properties are obtained from the physical properties of the material itself, the material thickness, or both.

Also, it is preferable that the puff P1 of the first form shown in FIG. 1 is configured to ensure excellent touch and spreadability, by having the first fixer F1, when observed from a top of the container puff, located inside an applicator surface to be hidden by the applicator surface S or the exposed surface of the first skin 10 exposed when combined with the container and in contact with the skin, so as to prevent, together with the recess R, the hard components (first and second fixers or nozzle) from coming into contact with the object subjected to application, such as the skin.

Next, the container C having the puff P1 of the first form shown in FIG. 1 includes: a body C1 forming a storage C2 in which a stored material C6 such as cosmetics is contained; an inner cap C4 for fixing the puff P1 at the entrance of an opening C3; a fixing ring C4*a* that fixes the puff P1 to the inner cap C4 by lock coupling (FIG. 1) or screw coupling; and an outer cap C5 that is coupled (by lock coupling or screw coupling) to the inner cap C4 to prevent the constant exposure of the puff P1.

The inner cap C4 has a discharge hole for the stored material C6 at a position corresponding to the through hole H of the puff P1.

If necessary, the puff P1 may be fixed by the nozzle 40 that is inserted into the recess R, penetrates the through hole H of the puff, and is fitted into the discharge hole of the inner cap C4.

The nozzle 40, as shown in the upper dash-dotted line circle of FIG. 1, has a discharge path 47 corresponding to the through hole H formed from top to bottom, and has a head 41, a connecting portion 43 and a locking portion 45 in the top-to-bottom order.

It is preferable that the second fixer F2 and the flange around the discharge hole of the inner cap C4 are arranged at the top and bottom on the connecting portion 43 whose outer circumference is bent at a right angle and abruptly reduced at the lower end of the head 41 and the upper end of the locking portion 45, and separation of the second fixer and the inner cap is prevented by the lower surface of the head 41 and the upper surface of the locking portion 45. In addition, it is preferable that the locking portion 45 is configured to have a wide upper part and a narrow lower part, that is, a structure suitable for assembling by pressing the nozzle from the upper part of the recess to the lower part of the recess.

As shown in the upper right dash-dotted line circle of FIG. 1, in addition to the nozzle 40, the puff P1 is configured such that, the upper inward protrusion of the fixing ring C4*a* is fitted into the first fixer F1 around the lower end of the puff, and the lower inward protrusion of the fixing ring is in the form of being coupled to the lower annular groove of the inner cap C4, thereby further strengthening the state of adhesion of the puff P1 to the inner cap C4.

The upper inward protrusion of the fixing ring C4*a* is covered by the outer flesh of the round type first skin 10 protruding out of the first fixer F1 so as not to be exposed.

Also, the nozzle 40 is coupled through the recess R of the puff, the through hole H, and the discharge hole of the inner cap C4 to ensure a smooth discharge of the stored material C6 without leakage.

Further, the outer cap C5 of the container C has a contact protrusion C5*a* protruding downward at the center of the inner surface, that is, at a position corresponding to the recess R of the puff, and the lower end of the contact protrusion blocks the discharge path 47 at the top of the nozzle 40 to prevent in the first place the stored material C6 from leaking from the nozzle.

Figure 2:
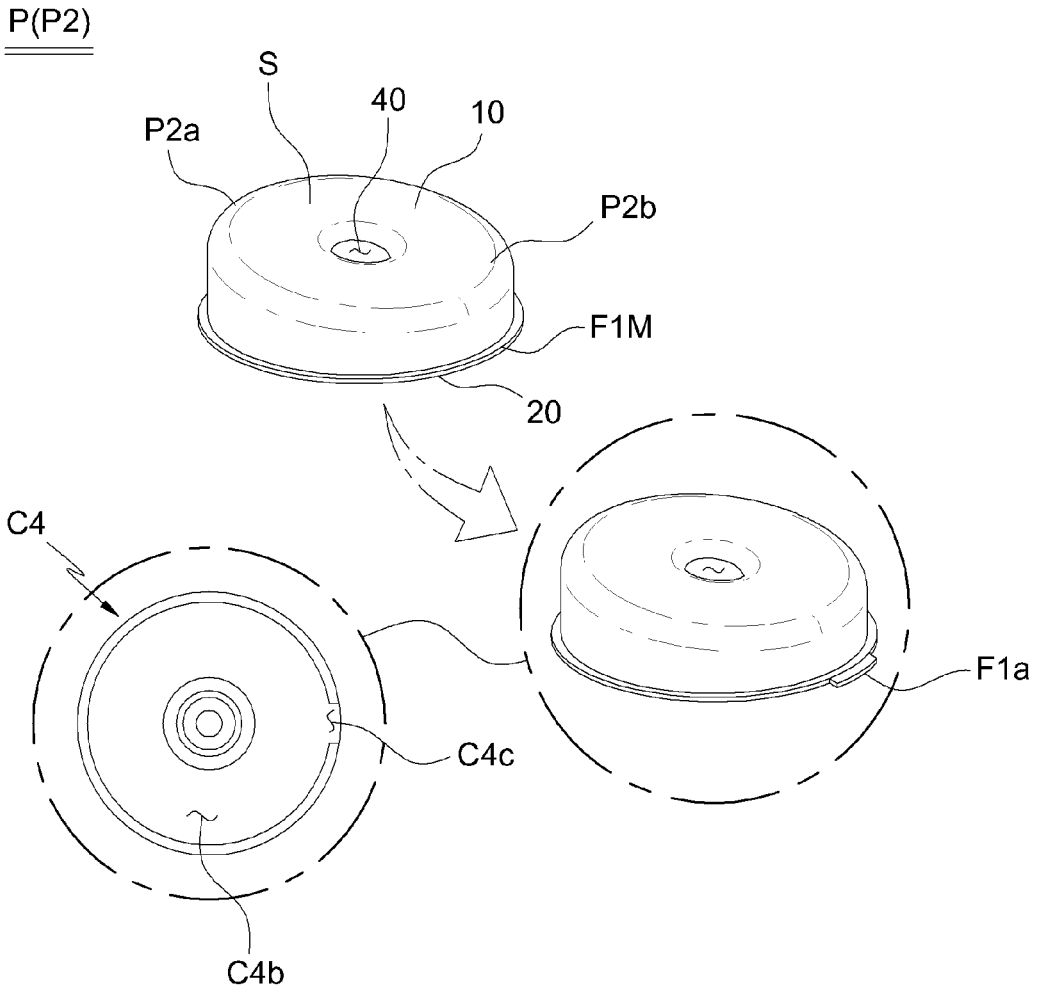
FIGS. 2, 3A and 3B are views showing a container puff in a form different from that of FIG. 1.

Next, FIG. 2 shows a puff P (P2) in a form different from that of FIG. 1. Most of all, a first skin 10, particularly an applicator surface S, has one high side (high surface portion P2*a*) and one low side (low surface portion P2*b*) to form an inclined shape, and, when observed from a top of the container puff, a first fixer F1M has a shape protruding to the outside of the applicator surface S.

In addition, as shown in a modified example in the lower right dash-dotted line circle, in the case of the puff P2 of FIG. 2, it is preferable that the first fixer F1M has a position fixing protrusion F1*a* protruding outward (especially protruding outward from the low surface portion P2*b* side).

As shown in the modified example in the lower left dash-dotted line circle of FIG. 2, the inner cap C4, having a seating portion C4*b* surrounded by an outer upward protrusion to accommodate a puff P2 having the position fixing protrusion F1*a*, includes a position fixing groove C4*c* such as that formed by cutting a portion of the outer upward protrusion so that the position fixing protrusion F1*a* is fitted, thereby preventing arbitrary rotation of the inclined shape puff P2 during use.

Figure 3A:
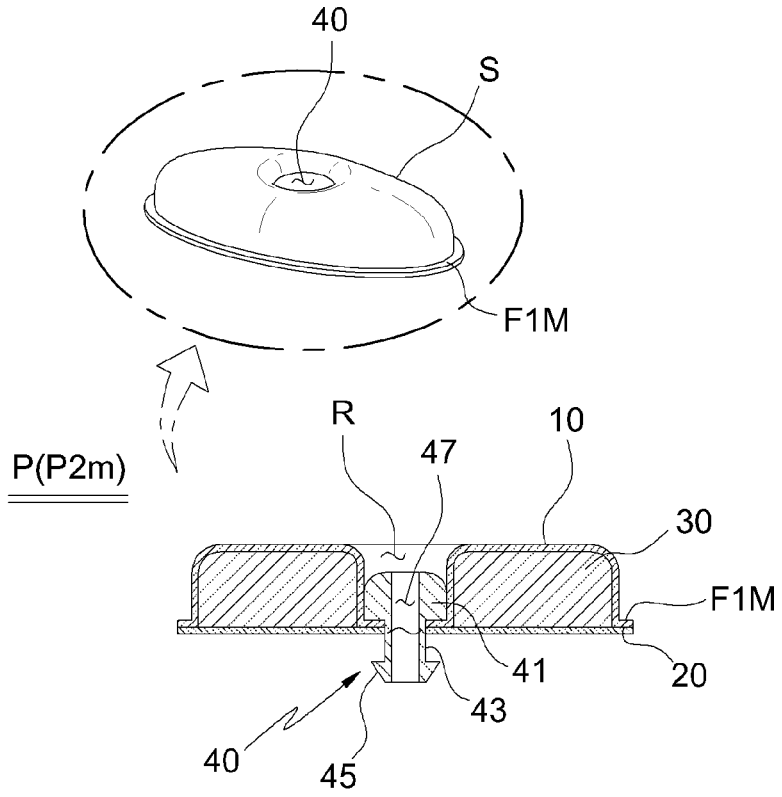

Next, in FIG. 3A, a modified example of a puff P2*m* is shown. The puff P2*m* has an applicator surface S being generally flat, and a first skin 10 that forms a smooth and round downward wall in the vicinity of a recess R and an outwardly protruding first fixer F1M.

Figure 3B:
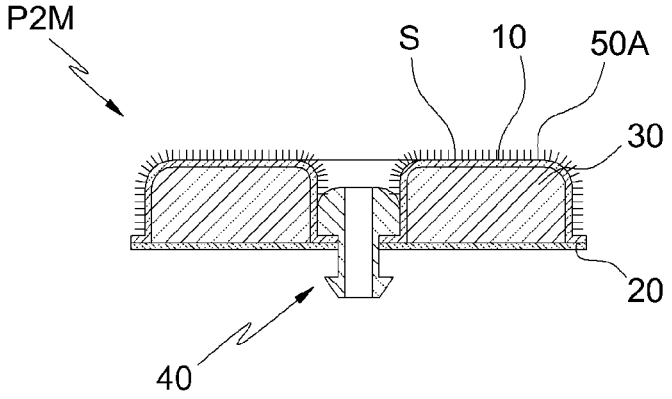

Also shown in FIG. 3B is a modified example of a puff P2M configured to have a first skin 10 having an applicator surface S that is a napped (fluffy raised) surface 50A treated by flocking method. The napped surface-type applicator surface of the puff may be selected according to a user's taste or the type of stored material to be applied.

Figure 5A:
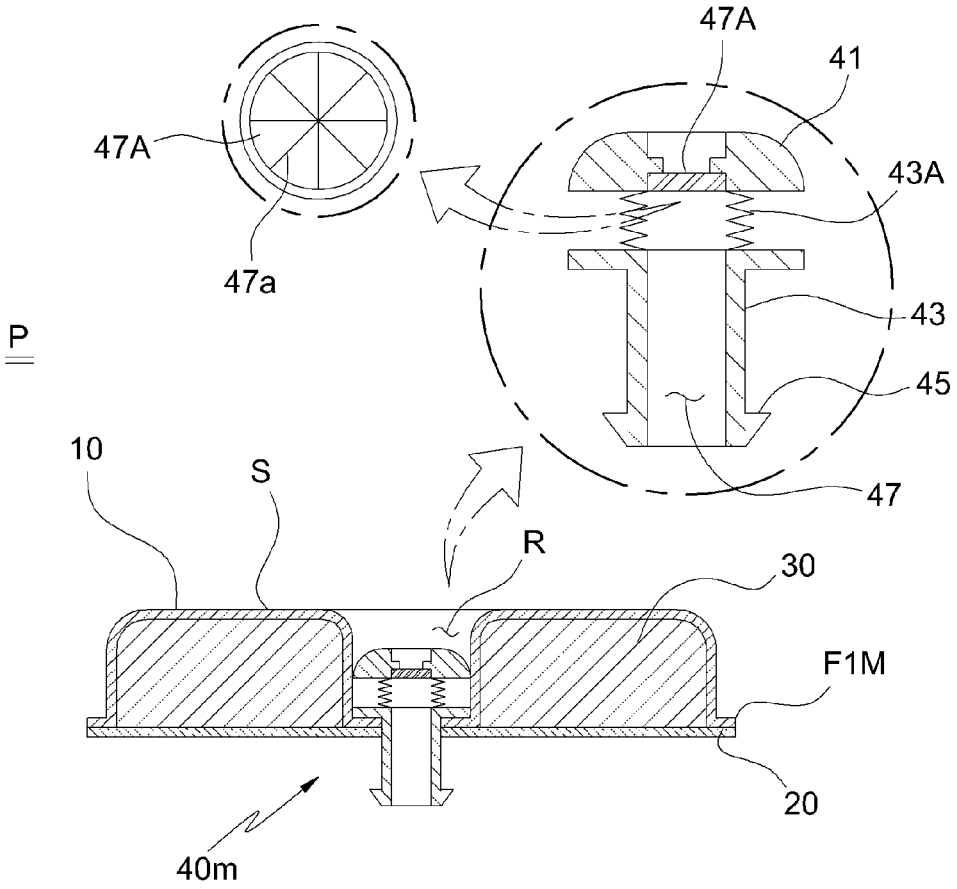
FIGS. 5A and 5B are a view of a container puff having a nozzle of a different shape from that of FIGS. 3A and 3B.
Figure 5B:
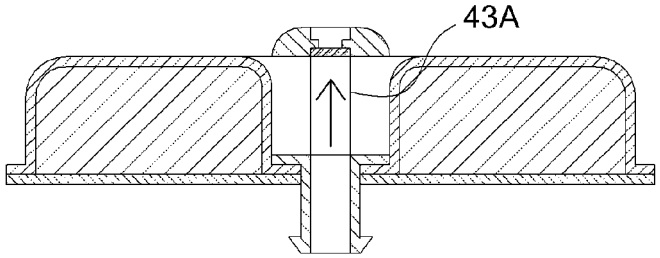

Next, in FIGS. 5A and 5B, a puff P with a deformable nozzle 40*m* is shown. The nozzle 40*m* has a connecting portion 43 under a head 41 deformed in the shape of a corrugated tube 43A.

Thus, when the puff is coupled to a container, the configuration changes from a state where no pressure is applied to the elastic tube-type container as shown in FIG. 5A and in a drawing in the upper right dash-dotted line circle to a state where pressure is applied to the elastic tube-type container by a user as shown in FIG. 5B, in which the corrugated tube 43A expands while the stored material is discharged so that the head 41 rises to prevent the stored material such as cosmetics from remaining in the recess R as much as possible. The elevation of the head 41 is exaggerated for convenience of understanding.

Also, this deformable nozzle 40*m* is, as shown in the upper right and left dash-dotted line circles of FIG. 5A, provided with a sealing disk 47A that blocks the discharge path 47 of the nozzle. Specifically, when a user applies pressure to the tube-type container, the radially incised elastic disk opens upwards according to incision lines 47*a* to open the discharge path, and when not in use, the incision lines touch each other again due to elasticity to close the discharge path, preventing the inflow of outside air as much as possible.

Figure 6:
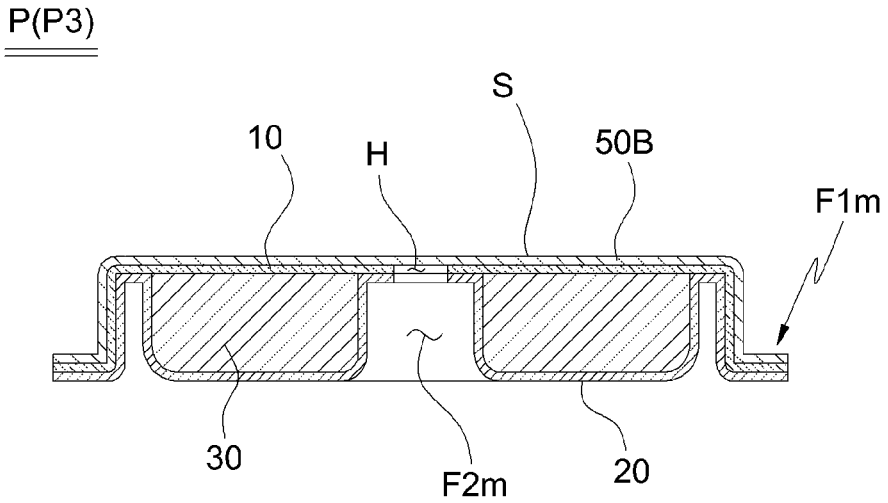
FIGS. 6 and 7 are views showing another type of container puff and container having the same.

Meanwhile, another modified puff P (P3) is shown in FIG. 6. The puff P3 is similar to the shape of the puff P2*m* and P2M in FIGS. 3A and 3B inverted, and is configured to have the first fixer F1*m* fixed by an inner cap C4*m* of a container as shown in FIG. 7, while the upper joint of 1-1 and 2-1 coupling parts corresponding to respective outer flanges of the first and second skins 10 and 20 is bent down and then bent outward so that an applicator surface S protrudes above the inner cap of the container.

In addition, on the upper portion of the first skin 10 located on the upper portion of the puff P3, a surface member 50B is provided for improvement of spreadability or tactile feeling. The surface member 50B may be, for example, a cosmetic absorbent member made of a material such as polyurethane foam. Also, if necessary, the surface member may be a member for improving cushion properties.

In the case of the puff P3 having the applicator surface S composed of such surface member 50B, the first skin may be made of a soft material or a hard material, and the second skin may be made of a hard material or a soft material. If necessary, the first and second skins may be both hard materials (in this case, the tactile feeling and application characteristics are secured by the surface member) or soft materials (in this case, bonding strength and the stiffness are secured by the improved strength (rigidity) due to the combination of the two skins).

Figure 7:
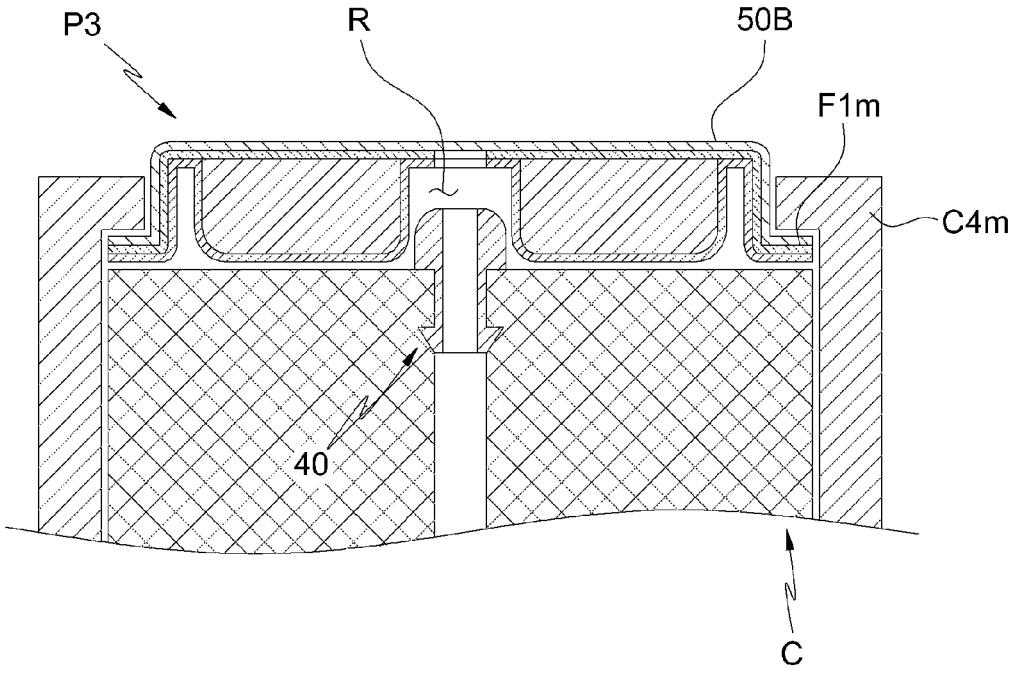

A recess R located under a through hole H surrounded by the second fixer may be used without a nozzle or, as shown in FIG. 7, the head of the nozzle 40 coupled to a discharge hole of an inner cap (not shown) partially blocking the opening of a container may be arranged inside the recess R.

In the above description, commonly known techniques related to types of skin and cushion and specific manufacturer specifications, and specific types of container stored material, etc. have been omitted, however, those skilled in the art may easily guess, infer, and produce the container puff and the container having the same according to the present disclosure.

In addition, in the above description of the present disclosure, puffs and containers having a specific shape and structure have been mainly described with reference to the accompanying drawings. However, various modifications, changes, and substitutions to the present disclosure are possible by those skilled in the art, and such modifications, changes and substitutions should be construed as falling within the scope of protection of the present disclosure.

The invention claimed is:

1. A container puff comprising:

a first skin having a 1-1 coupling part for an outer flange, a recess at a central portion thereof including an inner flange at an end of the recess, and a 1-2 coupling part for the inner flange;

a second skin having a 2-1 coupling part coupled to the 1-1 coupling part to form a first fixer, a 2-2 coupling part coupled to the 1-2 coupling part to form a second fixer, the second fixer forming a through hole surrounded by the second fixer;

a storage part formed between the first skin and the second skin, and sealed by the first fixer and the second fixer;

a cushion filling the storage part to provide elasticity;

a container having a body forming a storage in which a stored material is contained, and an inner cap coupled to an entrance of an opening of the body, the inner cap having a discharge hole; and a nozzle having a discharge path and coupled to the recess and the through hole, wherein the nozzle includes:

a head fitted into the recess;

a connecting portion formed at a lower end of the head and passing through the through hole and the discharge hole, an outer circumference of the connection portion being smaller than that of the head and fitted with a flange around the discharge hole; and a locking portion formed at a lower end of the connection portion, an upper surface of the locking portion being larger than the outer circumference of the connection portion and in close contact with an inner surface of the inner cap, thereby preventing the nozzle from separating from the container.

2. The container puff of claim 1, further comprising: a fixing ring configured to couple the second skin on an upper surface of the inner cap.

3. The container puff of claim 1, wherein the nozzle is accommodated inside of the recess.

4. The container puff of claim 1, wherein the first skin is made of a soft material, and the second skin is made of a hard material.

5. The container puff of claim 1, wherein an absorbent member is coupled to a surface of the first skin that is exposed when combined with the container and configured to come into contact with a user's skin.

6. The container puff of claim 1, wherein when observed from a top of the container puff, the first fixer is located inside an applicator surface of the first skin to be hidden by the applicator surface of the first skin that is exposed when combined with the container and configured to come into contact with a user's skin.

* * * * *